United States Patent [19]

Camusot

[11] 4,058,939

[45] Nov. 22, 1977

[54] TIERED GRANDSTAND

[76] Inventor: Gerard R. Camusot, Residence des Tours 23T, Glin-Mons, Belgium, B-7410

[21] Appl. No.: 615,906

[22] Filed: Sept. 23, 1975

[30] Foreign Application Priority Data

| | | |
|---|---|---|
| Sept. 27, 1974 | Belgium | 16198 |
| Aug. 1, 1975 | Belgium | 645123 |

[51] Int. Cl.[2] ..... E04H 3/12

[52] U.S. Cl. ..... 52/2; 52/8; 297/DIG. 3

[58] Field of Search ..... 52/2, 6, 8, 9; 297/DIG. 3

[56] References Cited

U.S. PATENT DOCUMENTS

| | | | |
|---|---|---|---|
| 1,421,857 | 7/1922 | Store | 52/2 |
| 2,105,080 | 1/1938 | Jagschitz | 52/1 |
| 2,999,041 | 9/1961 | Lappala | 52/2 |
| 3,086,753 | 4/1963 | Cushman | 52/2 |
| 3,337,999 | 8/1967 | Prus | 52/2 |
| 3,353,309 | 11/1967 | Kwake | 52/2 |
| 3,416,762 | 12/1968 | Headrick | 52/2 |
| 3,503,521 | 3/1970 | Desty | 61/1 F |
| 3,611,648 | 10/1971 | Barnett | 52/2 |
| 3,641,770 | 2/1972 | Fitzgerald | 61/1 F |
| 3,676,976 | 7/1972 | McAllister | 52/2 |
| 3,768,467 | 10/1973 | Jennings | 52/2 |
| 3,885,360 | 5/1975 | Fraioli | 52/2 |

OTHER PUBLICATIONS

New York Times, Nov. 20, 1967, p. 56.

Principles of Pneumatic Architecture by R. N. Dent, Halsted Press ©1972; pp. 47, 49, 160, 162, 182.

*Primary Examiner*—Price C. Faw, Jr.

*Assistant Examiner*—Henry Raduazo

*Attorney, Agent, or Firm*—Holman & Stern

[57] ABSTRACT

An easily transportable tiered grandstand consisting of a collapsible fluid-tight casing erectable by filling with a fluid and/or solid substances, such as gas and/or water, the casing having a base portion adapted when the casing is erected, to rest on a substantially flat horizontal support surface such as the ground and having a top portion which in the erected position forms a plurality of tiers. Flexible elements are provided internally of the casing connecting the bottom and top portions of the casing and being under tension when the casing is erected. Seats and gangways may be mounted on the top portion.

23 Claims, 23 Drawing Figures

TIERED GRANDSTAND

BACKGROUND OF THE INVENTION

This invention relates to an easily movable tiered grandstand. There are numerous uses for which tiered grandstands have to be displaced. As a rule, tired grandstands comprise a metal or wooden frame composed of dismantlable elements. Use has recently been made of telescopic grandstands, such as those described in Belgian Patent Nos. 769,589, 812,383 and 815,482.

Conventional framed structures have a number of disadvantages, including the considerable time necessary for assembly and dismantling, the need to have available a large, experienced work force, the relatively high cost of the arrangement, and also the very great weight and the size of the dismantled grandstand.

Conventional grandstands generally require an even and preferably horizontal ground, and also good carrying capacity in order to receive these grandstands.

The invention aims at obviating the disadvantages of heretofore known grandstands by avoiding the use of a rigid supporting framework.

SUMMARY OF THE INVENTION

Accordingly, the present invention consists in a tiered grandstand, comprising at least one collapsible fluid-tight casing erectable by being filled with a fluid and/or solid substance and having a base portion which is adapted, in the erected condition of the casing, to rest on a substantially flat horizontal support surface, and having a top portion which in the erected condition of the casing forms a plurality of tiers. Advantageously, said casing is erectable by being inflated with a gas, for example air.

Inflatable structures have recently been substantially developed, particularly for the purpose of forming tents serving as exhibition halls and the like. In inflatable structures of such kind which serve as tents, the pressure applied inside the structure is intended essentially to support only the dead weight of the structure. In the tiered grandstands of the invention the inflatable casing essentially assumes the function of supporting steps and other accessories such as staircases and hand-rails, and also the weight of the spectators. A structure of this kind enable such weights to be supported satisfactorily, while being sufficiently stable in service. The utilisation of an inflatable casing provides the advantage of considerably reducing the cost price of a tiered grandstand, while making it possible, by simple inflation, to erect the grandstand very rapidly and also to enable it to be rapidly dismantled by deflating the casing. Furthermore, the very design of a supporting structure resting directly on the ground enables it to adapt itself to grounds whose irregularity of carrying capacity would prevent the erection of conventional grandstands. Because of the absence of a metal or other framework, no dismantling operation is necessary, the use of a large, skilled work force is avoided, and the deflated grandstand can be completely folded up.

The present grandstand is preferably so constructed that at least a part of the casing is composed of a flexible material, which is made rigid by the pressure prevailing in the casing after the latter has been inflated. Use is generally made of a high tenacity PVC coated polyester cloth which is fireproof and does not propagate flames, such as cloths corresponding to the German standard DIN 4102. Cloths of this kind are available in grades having a strength of 14 metric tons per linear meter.

The stand of the invention may advantageously comprise a plurality of casings, which may be separable, juxtaposed or joined together so as to form the body of the supporting structure, which in the case of a tiered stand preferably has in cross-section a substantially triangular or trapezoidal shape.

The use of a plurality of casings permits variable modulation, that is to say on the basis of a starting module it is possible by juxtaposing a plurality of identical or different modules to form tiered stands of different dimensions.

In order to enable the casing to retain the desired shape after inflation, flexible elements are advantageously incorporated in the casting to connect the face of the structure which rests on the ground and the face intended to constitute the tiers, and optionally also connecting the faces of the structure which rest on the ground and/or the faces intended to support the tiers to one or more adjacent faces, these flexible elements being stressed in tension when the structure is inflated. It is advantageous for these flexible elements to be composed of cables; preferably of nylon, or of strips which facilitate the formation of compartments in the inflatable casing.

The material forming the casing is joined by ultrasonic means or by stitching with the air of nylon thread. The strength of any of the joints must be practically identical to the strength of the material itself. Furthermore, in order to achieve rigidity the casing is preferably provided in the longitudinal direction with spaced stiffening elements which are substantially parallel to one another and which are fastened to the face of the casing intended to form the tiers. The aforesaid flexible elements are generally connected directly to these stiffening elements. The arrangement of the stiffening elements in the longitudinal direction, with a parallel, spaced arrangement, makes it possible for the casing to be folded up in the longitudinal direction after deflation. The aforesaid tubes are preferably disposed inside the structure with the aid of gussets fastened to the casing and preferably formed by a folded portion of the latter.

The tiered grandstand of the invention is conveniently equipped with staircases and safety ramps, which are generally not integral with the grandstand structure and which are placed in position by rapid engagement on the aforesaid stiffening elements. The seats disposed on the tiers may in turn be composed either of removable elements or of elements joined to the material of the casing. In the case of elements joined to the casing material, the seats must be made of a material, such as a foam material, which can be compressed when the casing is folded up, or else be in the form of special inflatable structures which will be described hereinbelow. A predetermined number of reinforcements may also be provided, which are intended to protect the casing against vandalism, while a series of steps are also taken to prevent the accidental tearing of the casing from causing the stand to collapse.

A fluid under pressure which is intended to inflate the structure is usually supplied by an air compressor controlled by a pressure gauge contactor which starts up the compressor again as soon as the pressure inside the stand falls below a minimum required value. Thus, in the event of a substantial leak, for example a tear over a length of several meters, the air delivered by the compressor will without difficulty make up the loss of pressure from the tear and thus ensure the stability of the tiers. In the event of current failure or a breakdown of the compressor, a cloth flap serving as non-return valve will prevent deflation. For inflating the structure it is advantageous to select an air impeller having a rotational speed of 3000 rpm, supplying a pressure of from 300 to 500 or advantageously 400 mm water column and a delivery per hour amounting to approximately 4 times the volume to be inflated. The impeller is advantageously so selected that when the required pressure inside the casing is reached, the delivery of the impeller will be practically zero, thus allowing the impeller to turn permanently if desired.

BRIEF DESCRIPTION OF THE DRAWINGS

In order that the invention may be more readily understood, reference is made to the accompanying drawings which illustrate diagrammatically and by way of example several embodiments thereof, and in which.

DETAILED DESCRIPTION OF PREFERRED EMBODIMENTS

Figure 1:
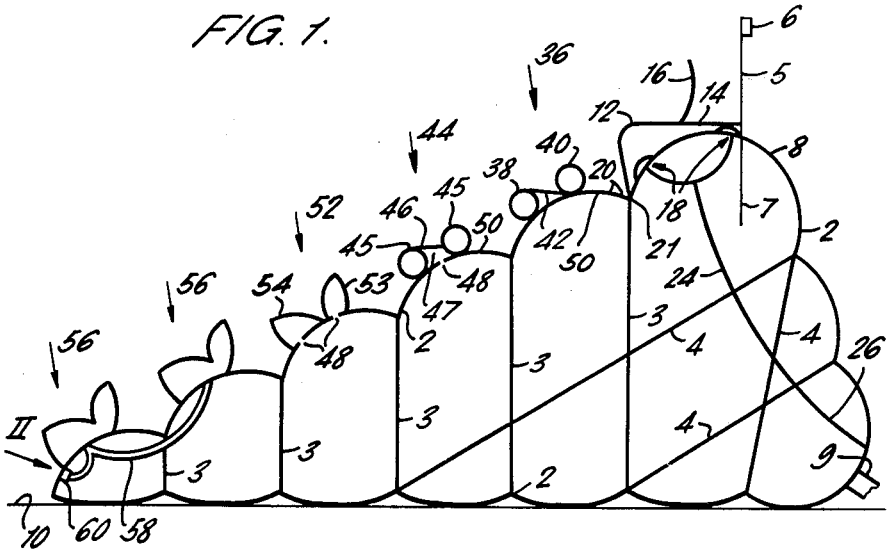
FIG. 1 is a side view showing a stand according to one embodiment of the invention and carrying various types of seats.

The grandstand 1 (FIG. 1) is composed of a fluid-tight casing 2 preferably made of cloth. Flexible elements 3 and 4, which in the embodiment envisaged are cables, preferably of nylon, are disposed in the interior and subjected to tensile force when the stand 1 is inflated. These elements in tension have the function of giving the stand a predetermined shape different from spherical and cylindrical shapes, particularly so that after inflation a tiered grandstand will be obtained.

A railing is composed of uprights 5 (only one shown in FIG. 1), carrying a rail 6 and fastened to the side faces of the stand by their bottom portions 7. Bent intermediate uprights (not shown) may also be used, and they are then fixed to the portion 8 of the casing.

Pressure inside the casing 2 is obtained by the injection of air through an opening 9 with the aid of a compressor or of other suitable means (not shown). The stand rests on the ground 10 and, because of the nature of the inflated suppporting structure, the latter will adapt itself to irregularities of the ground and does not need a ground having a high carrying capacity.

The seats 12 are rigid shells of moulded plastics material and they are provided with an extension 14 forming a passage behind the seat back 16. On its bottom face the shell 12 is provided with two suction cups 18 which enable it to be fastened to the clasp of the casing 2. Correct positioning is achieved by means of the bottom edge 20 of the shell 12, which is placed in the groove 21 formed in the casing 2 through the presence of the tension element 3. After pivoting, the two suction cups 18 can cover the apertures formed in the cloth of the casing at the admission points of a branch pipe 24. The latter is connected to a suction device (not shown) which is connected to the end 26 passing out of the casing 2. A suction delay may be a separate machine or simply a connection to the suction side of the compressor or other means used for inflating the stand. On each side of the median line passing through the two suction cups 18, the shell 12 has a boss (not shown) which, by bearing against the casing material, provides the shells with lateral stability. In a modified embodiment (not shown) the seats are not individual but are disposed in a monobloc row. These seats, as well as the parts 5 and 6 of the railing, must be removed before the stand is deflated.

Figure 4:
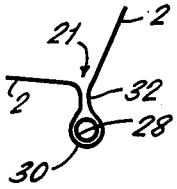
FIG. 4 shows in section the fastening of a stiffening tube.

In one embodiment of the invention (FIG. 4) the tension elements 3 and 4 are spaced from point to point over the length of the stand (parallel to the groove 21). In order to enable the groove 21 to remain substantially rectilinear and not to be deformed in successive arcs, a member 28, preferably a tube, is disposed in a loop 30 provided at this zone in the cloth and closed along the strip 32 by adhesive bonding or heat sealing or by any other means of joining.

In an alternative arrangement, the shell type seats 12 are fixed not by suction cups 18, but by elastic clips 34 (FIG. 3) adapted to clip to the tubes 28 when subjected to a downward vertical force. This clipping is effected at predetermined points along the groove 21 where the two portions of the loop 30 are not joined together over a predetermined length.

Although a single type of seat is generally used on a particular stand, the stand shown in FIG. 1 carries seats of various types by way of illustration.

The row of seats 36 is formed by an inflatable cushion 38 for the front and an inflatable cushion 40 for the back of the seat. These two cushions are continuous over the length of the stand 1 and are inflated separately. A cloth 42 stretched between these two cushions, as illustrated, widens the substantially horizontal area of the seat.

The seats 44 are similar to the seats 36, but the cushions 45 are formed of rolls of compressible foam material, while the intermediate cloth 46 forms an entirely closed space 47, which is nevertheless in communication with the pressure prevailing in the casing 2 by way of an aperture 48 of a diameter of 5 mm, which permits rapid inflation but prevents any substantial leakage in the event of a puncture in the space 47.

The longitudinal passages 50 between the rows of seat serve for walking directly on the casing 2, which is substantially horizontal at these points.

The seats 52 are individual seats and are formed of inflatable cushions 53 and 54 having the shapes shown in FIG. 1. They are inflated through apertures 48 in the manner described above and, like the seats 36 and 44, they are permanently fastened by adhesive bonding or otherwise to the casing 2.

Figure 2:
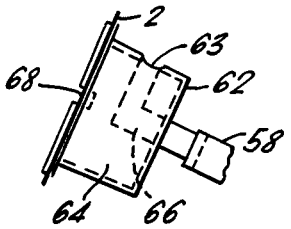
FIG. 2 is an enlarged view of the detail II in FIG. 1.

The seats 56 are of a type similar to the seats 52 but they are not in communication with the actual interior of the casing 2, but with flexible branch pipes 58 which are disposed in the casing and which lead to a valve 60 shown in greater detail in FIG. 2.

The pipe 58 is in communication with a housing 62 providing with a lateral hole 63 and containing a valve body 64 together with a bend pipe 66. By rotating the valve body 64 with the aid of a key introduced into a cavity 68, communication between the pipe 58, and therefore the seats 56, and the pressure prevailing in the casing 2 is established or interrupted. After inflation, the seats are therefore preferably isolated from the pressure in the casing 2, in order to prevent the pressure in the casing 2 from falling excessively in the event of the seats being punctured.

Figure 5:
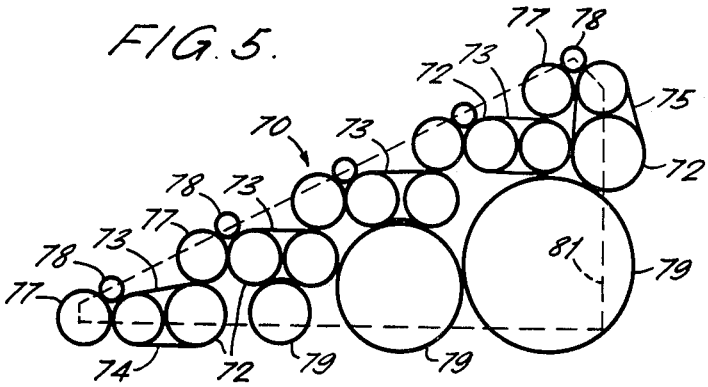
FIG. 5 is a side view showing another embodiment of a stand according to the invention.

The stand 70 which is shown in FIG. 5 is formed solely of inflated tubes of various diameters; some of the tubes are connected to form pairs 72 by two stretched cloths 73 and 74 or 75, 76. The upper cloths 73 form substantially flat floors to provide longitudinal access to the seats. The latter are formed by front tubes 77 and back tubes 78. Tubes 79 of larger diameter serve for support at various heights at the bottom of the stand.

In the embodiment shown in solid lines in FIG. 5, the tubes are all joined together and after deflation the stand can be rolled up without the elements being separated. Another embodiment of stand is formed by tubes which are disposed similarly but are independent of one another. For transport purposes each tube or pair of tubes 72 can then be manipulated separately, thus limiting maximum weights and dimensions of the parts which have to be moved. For connection purposes use is made of straps (not shown) and/or at each end of the stand there is provided a triangular cloth 81 shown in broken lines. Connections may be made by screws or by means of heavy-duty press-studs. The connection elements (not shown) are fixed on local reinforcements.

In cases where use is made of a plurality of juxtaposed or of connected superimposed structures, it may be advantageous to inflate the upper structures with air while the lower structures are filled with water. Ballasting of the lower part of the structure is thereby effected.

Figure 6:
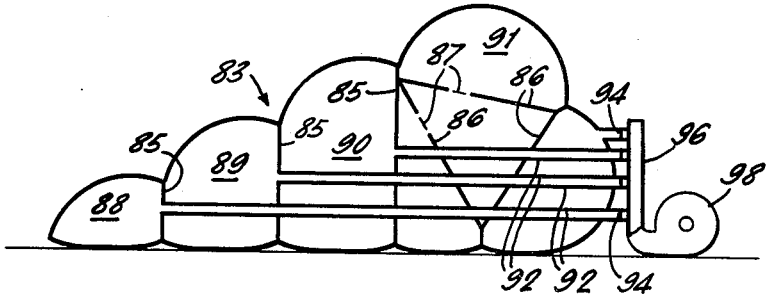
FIG. 6 shows in section a further embodiment of a stand according to the invention.
Figure 7:
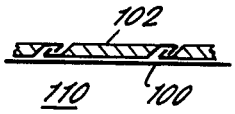
FIGS. 7 to 13 and 15 are fragmentary sections of different types of reinforced cloth used in the production of the stands.
Figure 8:
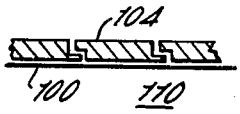

The stand 83 shown in FIG. 6 comprises elements 85 in tension which are fluid-tight cloths fixed, for example by adhesive bonding, over their entire periphery to the casing 2. There are also non-fluid-tight cloths 86 likewise in tension and optionally provided with apertures 87. The cloths 85 bound successive spaces 88, 89, 90, 81, which are each connected by flexible cloth tubes 92 to an air impeller 98 with the interposition of a respective isolating valve 94 and a common pipe 96. After inflation of the casing 2 the valves 94 are closed and the impeller 98 stopped. In this way, in the event of a puncture of the casing material in the zone of one of the spaces 88 to 91, only part of the stand is deflated, so that modifications of the shape of the structure as a whole are limited.

Figure 9:
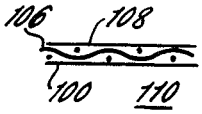
Figure 10:
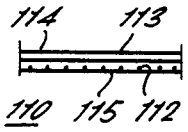
Figure 11:
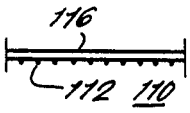
Figure 12:
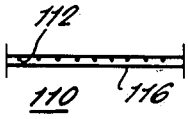
Figure 13:
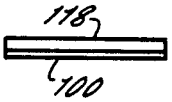

FIGS. 7 to 13 show reinforced cloths which are in particular suitable for preventing damage by means of knives or needles. The cloth 100 of a casing or part of a casing may be protected by means of interlocking slats 102, which are hollow and of plastics material (FIG. 7) or slats 104 of wood or other material with labyrinth overlapping (FIG. 8), or by means of a woven material or trellis 106 which may be covered by a second cloth 108 (FIG. 9). The cloth 100 may be adhesively bonded or joined over its entire surface or locally to these protection means 102, 104, 106, 108, or simply be applied against these elements (when in service) by the pressure in the internal space 110.

Alternatively, a trellis 112 (FIG. 10) may be embedded in a fluid-tight layer 114 on the two faces 113, 115 or be joined internally (FIG. 11) or externally (FIG. 12) to a cloth 116. The woven material 116 may be composed of metal threads, glass fibres, plastics material, or other materials, and the trellis may be replaced by a woven material or vice versa.

A fluid-tight cloth 100 suitable for the casings of grandstands and therefore withstanding heavy tensile forces (FIG. 13) may also be protected by an outer layer 118 of a material which is suitable for withstanding wear and the penetration of knives or needles.

Figure 14:
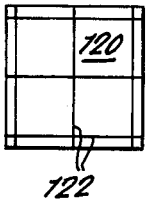
FIG. 14 is a front view of the sample shown in FIG. 15, FIGS. 16 to 18 are detail views showing types of fastenings of flexible tension elements.
Figure 15:
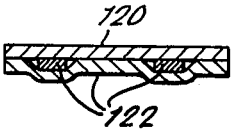

The cloth shown in FIGS. 14 and 15 is composed of a smooth layer 120 which carries in squares, for example with a pitch of 300 or 400 mm, reinforcing strips 122 adhesively bonded or joined to stop the progression of a tear or of a possible cut, and therefore to limit the leak to a rate of flow which is acceptable to enable the pressure to remain adequate in the casing, provided that the air supply remains in operation or is put back into operation, for example by a pressure gauge contactor (not shown).

Figure 3:
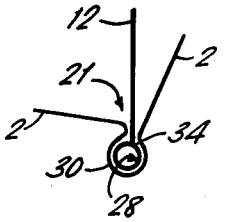
FIG. 3 shows in section a modified form of the seat fastening shown in FIG. 1.
Figure 16:
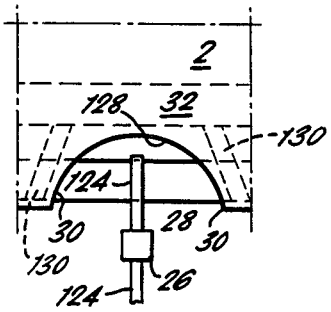

A flexible tension element for the grandstand of the invention is a cable 124 (FIG. 16) fastened by means of an accessory 126 around the tube 28. In order to make the fastening point accessible, the loop 30 formed by the material of casing 2 around the tube 28 (see FIG. 4) has a local cut-out 128. If the local non-connection system shown in FIG. 3 is used in conjunction with the cut-out 128 (FIG. 16), it is preferable to provide small fluid-tight adhesively bonded areas 130 in order to avoid systematic leaks.

Figure 17:
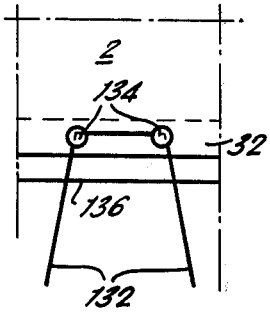

In an alternative arrangement, the cables 124 are replaced by lightweight cords 132 (FIG. 17), for example of nylon, of which there will be a larger number than that of the cables and which, being subjected to a smaller stress, are joined by rivets 134 provided with washers in the connection zone 32. Because of their number they can also sufficiently distribute the load to enable the tube 28 to be dispensed with and therefore also the loop 30; the cloth is thus simply folded at the edge 136 of the zone 32.

Figure 18:
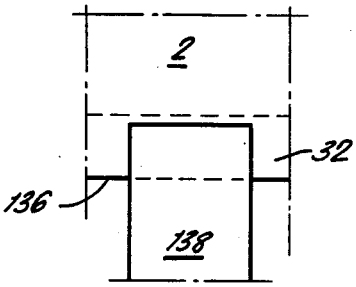

The cables 124 may also be replaced by strips 138 (FIG. 18), which are simply adhesively bonded or joined to the zone 32.

Figure 19:
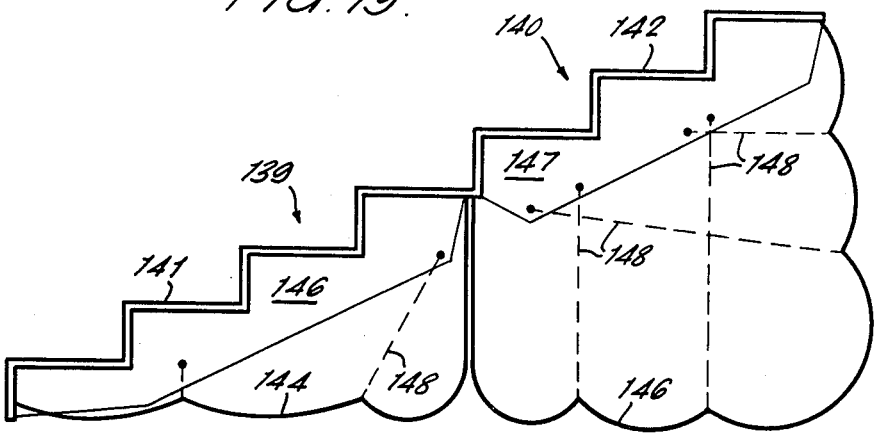
FIG. 19 is a side view showing another embodiment of a stand according to the invention.

Another grandstand (FIG. 19) is formed of two main parts 139 and 140, which may be attached to one another by means which are not shown. The upper surfaces 141, 142 are rigid and fluid-tight, being for example formed of sheet metal or panels of wood or other materials, covered with fluid-tight cloths (not visible) forming two casings together with the flexible portions 144 and 145. The rigid panels are reinforced by stiffeners 146, 147, which may also form a two-directional network. The structure is also provided with tension elements 148. The inflation of the casings forms a stand which is much lighter and which when deflated is much less bulky than rigid stands provided with frames of types used prior to the invention.

Figure 20:
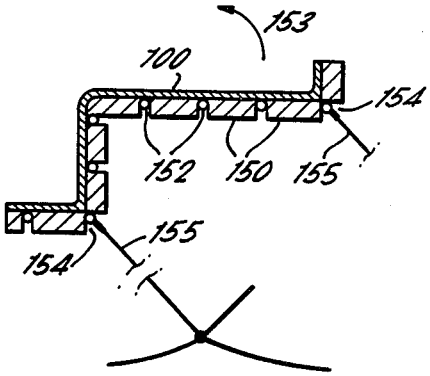
FIG. 20 shows in fragmentary section a form of construction of a tier or step.

A construction of steps or staircases (FIG. 20) is provided, under the cloth 100, with slats 150 joined by hinges 152. Under the effect of internal pressure the slats bear against one another by their edges and together form a rigid panel which (within certain limits of carrying capacity) therefore does not assume the natural curved shape of an inflated flexible casing. On the other hand, the whole arrangement can be rolled up by bending in the other direction, as indicated by the arrow 153 on completion of the deflation. The internal corner hinges 154 can in addition receive tension elements 155.

Figure 21:
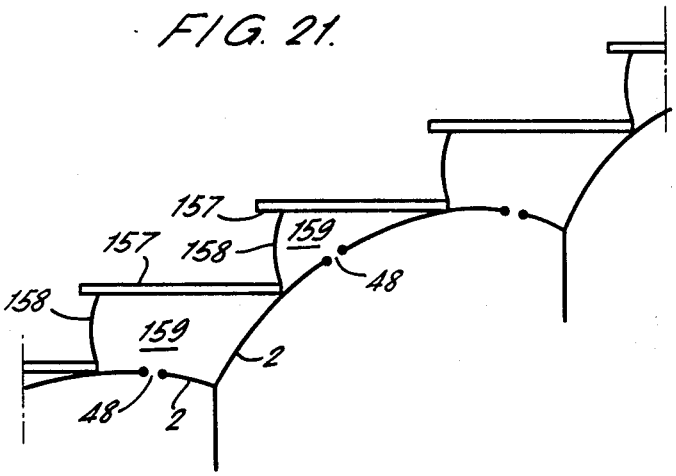
FIG. 21 is a side view of one form of construction of the steps.

A staircase (FIG. 21) is composed of steps of rigid panels 157 and risers 158 of cloth, forming the spaces 159 which are inflated by being brought into communication with the casing 2 by means of the apertures 48.

Figure 22:
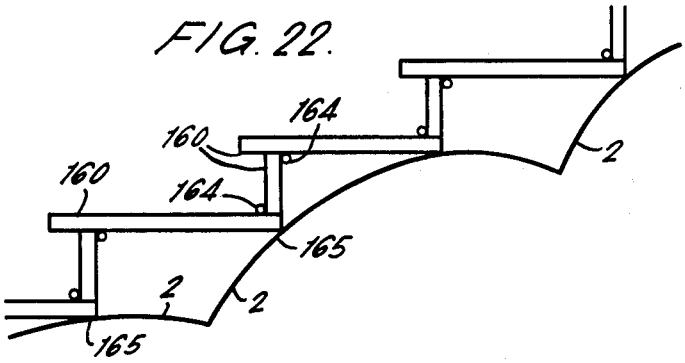
FIG. 22 is a side view showing a modified step arrangement.

Another staircase (FIG. 22) is composed of rigid panels 160 which are connected to one another by means of hinges 164, thus permitting folding into a small volume. The staircase can be joined at the points of contact 165 with the cloth of the housing 2, which then follows the rigid portion 160 on folding.

Figure 23:
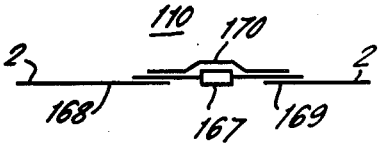
FIG. 23 is a sectional view of a slide closure means used in the casing of a stand.

The casing may be provided with an aperture which, for example, will permit the passage of a man for internal inspection purposes, and also will permit rapid deflation. This rectilinear aperture is provided with a slide type closure means 167 shown in section in FIG. 23, which is joined along lines 168 and 169 to the casing 2. A flexible flap 170 is fixed on one side 169 and is free on the other. It covers the slide closure means in an entirely fluid-tight manner because of the pressure of the internal space 110.

The tiered structures of the invention make it possible to reduce cost price to a value corresponding approximately to one-third of that of conventional metal framed stands. The time required for inflating the inflatable structure is approximately one quarter of an hour, with a small work force. The advantage for dismantling purposes is substantially equivalent.

A practical example consists in forming stands of 8 meters by 8.60 meters, capable of accommodating 500 persons, the spacing of the tiers being 80 cm and each tier being connected by two steps of 40 cm to the next tier.

It is thus found that the tiered stand of the invention constitutes considerable progress from every point of view in comparison with conventional stands mounted on frames. It offers excellent stability even if overloaded, because it is not subject to the same risk of total collapse as in the case of a framed structure in the event of the fracture of an element of the frame. The presence of flexible elements, such as cables, incorporated in the structure, which are subjected to tensile stress after inflation, constitutes a particularly advantageous optional feature of the invention in the sense that, without hindering folding after deflation, they make it possible to impart to the inflated structure a stability which is particularly suitable for obtaining a tiered shape.

Although a certain number of preferred embodiments of the invention have been described, the latter is obviously in no way limited to these embodiments and various other modified embodiments remain possible within the scope of the appended claims. In particular, the invention is not limited to the materials mentioned by way of example for the construction of the casing and the cables, nor, obviously, is it restricted to the dimensions indicated. An inherent feature of the tiered grandstand of the invention consists moreover of the great freedom with which grandstand shapes can be combined with different designs of seats and other optionally integrated accessories, with a cost price of the order of 30% of that of telescopic grandstands.

Whilst in the foregoing description the material inflating the casing was essentially a fluid, particularly air or water for the lower compartments of the casing, it is to be understood that the invention is not limited to these fluids. It is in particular possible for the casing to be filled with plastics foam, particles or solid or hollow pellets or balls of different dimensions.

It is also possible for the casing to be inflated and practically completely filled, for example by pneumatic conveying, with particles or balls of plastics material, and then to apply a partial vacuum to the casing so that the casing is applied against the material filling the casing. In this manner a particularly rigid casing is obtained.

I claim:

1. A completely self-supporting tiered grandstand, comprising at least one collapsible fluid-tight casing having walls erectable by being filled with a fluid and/or solid substance and having a base portion which is adapted, in the erected condition of the casing, to rest on a substantially flat horizontal support surface, and having a top portion which in the erected condition of the casing defines a plurality of tiers, each tier having a portion defining a flat surface dimensioned and structured for walking thereupon.

2. A grandstand as claimed in claim 1, wherein said casing is erectable by being inflated with a gas, for example air.

3. A grandstand as claimed in claim 2, wherein water is introduced into the casing to form a ballast.

4. A grandstand according to claim 2, wherein at least a part of the walls of the casing is made of a flexible material rendered rigid by the pressure prevailing in the casing after inflation of the latter.

5. A grandstand according to claim 1, comprising a plurality of said casings.

6. A grandstand according to claim 5, wherein the casings can be separated from one another.

7. A grandstand according to claim 1, including flexible elements incorporated in the casing and connecting the portion of the casing which rests on the support surface and the portion forming the tiers, said flexible elements being subjected to tensile stressing when the casing is inflated.

8. A tiered grandstand according to claim 1, including flexible elements incorporated in the casing and connecting the portion of the casing resting on said support surface and the portion forming the tiers to one or more adjacent portions, said elements being subjected to tensile stressing when the casing is inflated.

9. A grandstand according to claim 1, wherein said casing has a substantially triangular shape in cross-section when it is inflated.

10. A grandstand according to claim 1, wherein said casing has a substantially trapezoidal shape in cross-section when it is inflated.

11. A grandstand according to claim 7, wherein said flexible elements are constituted by cables.

12. A grandstand according to claim 7, wherein said flexible elements are constituted by strips which divide the inflated casing into compartments.

13. A grandstand according to claim 7, wherein in a longitudinal direction said casing is provided with stiffening elements which are substantially parallel and spaced relative to one another and fastened to the portion forming the tiers, and to which the said flexible elements are joined.

14. A grandstand according to claim 13, wherein the stiffening elements are disposed inside the inflatable casing with the aid of gussets joined to the casing.

15. A grandstand according to claim 1, wherein at least a part of the surface of the casing is fastened to a series of substantially contiguous rigid slats.

16. A grandstand according to claim 1, wherein at least a part of the walls of the casing is fastened to at least one rigid, optionally articulated panel.

17. A grandstand according to claim 1, wherein at least a part of the walls of the casing is provided at least along one line with a reinforcement reducing the possibility of a tear being propagated beyond the said line.

18. A grandstand according to claim 1, wherein at least a part of the walls of the casing is reinforced by woven material.

19. A grandstand according to claim 1, including at least one additional element designed to be placed under pressure and communicating with the casing by an aperture which prevents excessive leakage in the event of the puncturing of the said additional element.

20. A grandstand according to claim 1, including at least one additional element adapted to be placed under pressure and communicating with the casing by way of an aperture which can be closed after inflation.

21. A grandstand according to claim 19, wherein said additional element forms the seats disposed on the tiers.

22. A grandstand according to claim 5, wherein said plurality of casings form a series of superimposed compartments of which a bottom compartment is ballasted with the aid of water.

23. A grandstand according to claim 1, wherein the casing has a slide closure means provided with a sealing valve permitting access to the interior of the casing and permitting rapid deflation.

* * * * *